United States Patent [19]

West et al.

[11] Patent Number: 4,723,564

[45] Date of Patent: Feb. 9, 1988

[54] APPARATUS FOR CLEANING EXTERIOR AND INTERIOR OF A PAINT DISPENSING ROLLER

[75] Inventors: Daniel T. West, Crystal; Gary C. Polk, Eden Prairie, both of Minn.

[73] Assignee: Wagner Spray Tech Corporation, Minneapolis, Minn.

[21] Appl. No.: 767,830

[22] Filed: Aug. 20, 1985

[51] Int. Cl.[4] ..... B08B 3/04

[52] U.S. Cl. ..... 134/170; 134/172; 134/199

[58] Field of Search ..... 134/53, 54, 55, 94, 134/98, 99, 166 R, 167 R, 170, 172, 178, 199, 22.12, 18, 24, 34; 68/213; 401/122, 197, 208, 136; 15/1

[56] References Cited

U.S. PATENT DOCUMENTS

| | | | |
|---|---|---|---|
| 2,294,668 | 9/1942 | Karas | 134/170 X |
| 3,545,875 | 12/1970 | Schneider | 401/197 |
| 3,650,283 | 3/1972 | Lang | 134/170 X |
| 4,155,374 | 5/1979 | Diehl | 137/519.5 |
| 4,218,265 | 8/1980 | Fuchs et al. | 134/170 X |
| 4,299,244 | 11/1981 | Hirai | 134/170 X |
| 4,422,466 | 12/1983 | Schafer | 134/170 |
| 4,424,011 | 1/1984 | O'Brien et al. | 401/197 X |
| 4,508,465 | 4/1985 | Orton | 401/136 X |
| 4,517,699 | 5/1985 | Petricka | 68/213 X |
| 4,537,522 | 8/1985 | Charney et al. | 401/197 X |

*Primary Examiner*—Harvey C. Hornsby
*Assistant Examiner*—Frankie L. Stinson
*Attorney, Agent, or Firm*—Hill, Van Santen, Steadman & Simpson

[57] ABSTRACT

An apparatus for cleaning both the interior and exterior of a paint dispensing roller that has a water inlet attachable to a faucet with a one-way valve to prevent reverse water flow through the inlet, a first water outlet from which water is supplied through a conduit into the inside of the roller flushing it clean, and a ring holding the roller having a second water outlet communicating with the water inlet to supply water to clean the exterior of the paint roller. The ring snugly fits around the roller in order to hold it in place, and also functions to wipe the water from the roller.

18 Claims, 7 Drawing Figures

APPARATUS FOR CLEANING EXTERIOR AND INTERIOR OF A PAINT DISPENSING ROLLER

BACKGROUND OF THE INVENTION

1. Field of the Invention

The present invention relates to an apparatus for cleaning paint rollers, and in particular an apparatus that cleans both the interior and exterior of paint rollers.

2. Description of the Prior Art

Conventional means for cleaning paint rollers, such as soaking them in a bucket or spraying them with a hose, are very messy, time-consuming, and inefficient. Most of the devices developed to eliminate these problems consist of a cylinder to contain the entire roller and some type of a sprayer to penetrate the roller fibers to remove the paint. These devices are rather large and complicated and often too expensive for the average consumer. Such devices are described, for example, in U.S. Pat. Nos. 3,897,797, 3,731,697, 3,608,120, 3,587,599, 3,075,534, 2,985,178 and 2,831,488.

Another cleaning device described in U.S. Pat. No. 4,508,465 is designed for attachment to a garden hose and consists of a scraper that removes paint from the outer fibers and a separate nozzle that releases a high pressure stream of water to remove embedded paint. Although this device is more compact and better suited for the average consumer, it is still time-consuming because only a very small section can be cleaned with the scraper at a time. Also, it is awkward for the user to hold both the roller and the apparatus attached to the hose while avoiding paint or water spattering.

It is a problem in the art to provide a simple, inexpensive, timesaving, and non-messy device for cleaning the exteriors of paint rollers. Also, with the advent of paint dispensing rollers, a problem exists in providing a device that can easily and efficiently clean the interior of the roller while also cleaning the exterior.

SUMMARY OF THE INVENTION

It is an object of the present invention to provide a paint roller cleaner that can effectively clean both the exterior and interior of a paint roller simultaneously.

It is a further object of the present invention to provide a paint roller cleaner which is relatively simple in its construction and is inexpensive to manufacture.

Another object of the present invention is to provide a paint roller cleaner which is simple to use but capable of effectively cleaning a paint roller.

It is another object of the present invention to provide a paint roller cleaner that is compact and suited for the average consumer for use in his home.

In accordance with the foregoing objectives, the present invention provides a paint roller cleaner specifically designed to clean both the interior and exterior of a paint dispensing roller. The cleaning device has a threaded water inlet that can be attached to an ordinary faucet. The water then passes into a chamber and exits through two water outlets. A first water outlet is connected to a conduit which allows water to pass into the interior of the paint roller flushing it clean. Water also passes from the chamber into a ring structure surrounding the exterior of the paint roller. The water then exits the ring structure through a second water outlet flushing the roller fibers clean. This ring structure also functions to hold the paint roller in place while being cleaned.

The chamber into which water enters from the water inlet is equipped with a ball check valve. This ball check valve prevents reverse water flow thereby preventing contamination of the water source.

In one embodiment of the invention, the second water outlet is a continuous opening on the interior side of the ring structure to allow cleaning of the exterior of the roller. A second embodiment of the invention consists of multiple openings on the interior side of the ring structure to allow cleaning of the exterior of the roller.

DESCRIPTION OF THE PREFERRED EMBODIMENTS

Figure 1:
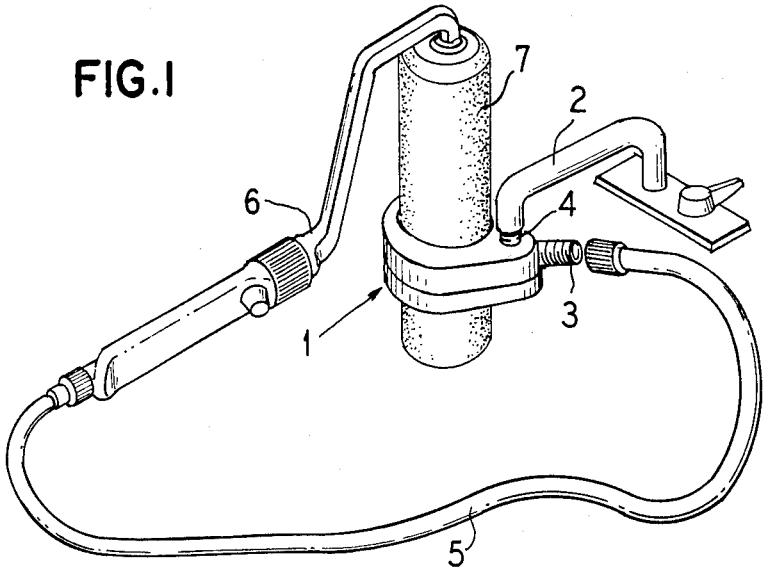
FIG. 1 is a perspective view of the paint roller cleaner apparatus in position for cleaning a roller.

The cleaning apparatus, generally designated 1, in position for cleaning is illustrated in FIG. 1. The apparatus 1 includes a threaded water inlet 4 attached to a faucet 2. The apparatus 1 is also equipped with a threaded first water outlet 3 that is attached to a conduit 5. The conduit 5 is in turn attached to the handle, generally designated 6, of the paint roller 7. The handle 6, during a painting operation, is supplied with paint from a reservoir by means of a suitable pumping device, and the roller 7 is provided with interior openings to permit paint (and during cleaning, water) to pass from the interior to the exterior of the roller 7.

Figure 2:
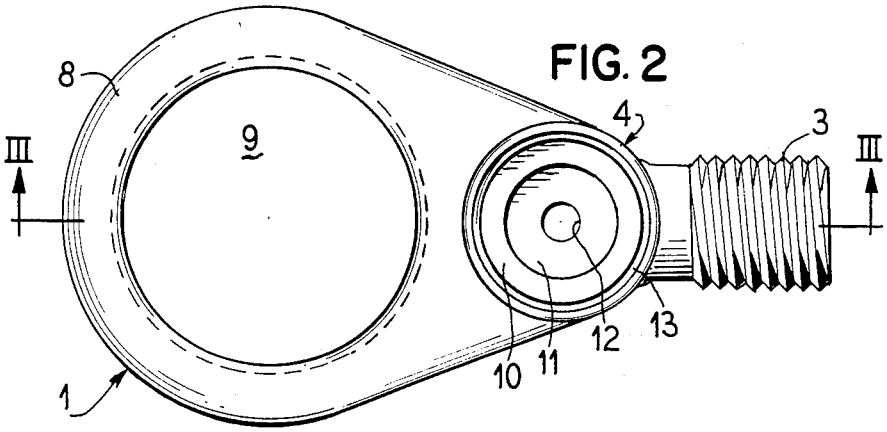
FIG. 2 is a plan view of the paint roller cleaning apparatus.

A more detailed illustration of the exterior of the apparatus 1 is given in FIG. 2. The ring structure 8 forms a hole 9 to allow insertion of the paint roller. The water inlet, generally designated 4, consists of a threaded interior wall 13 and a base 11 having an opening 12 and supporting a washer 10.

Figure 3:
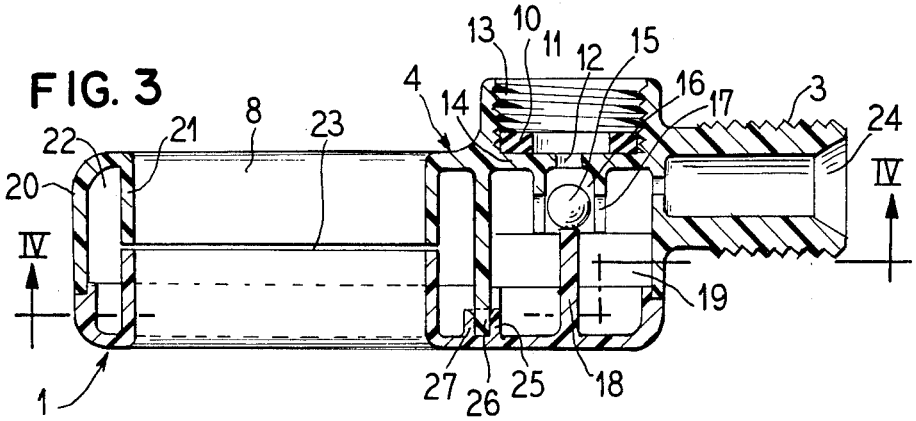
FIG. 3 is a cross-sectional view taken along line III—III of FIG. 2.

The water inlet 4 allows water to pass into a chamber 19 as shown in FIG. 3. This chamber 19 is equipped with a ball check valve consisting of a ball 15 supported by a post 18. A wall 17 surrounds the ball 15 forming a chamber 16. The ball 15 is larger than the opening 12 so that in the event of reverse water flow, as may be caused by unexpected negative pressure in the main, the ball 15 will move to the top of the chamber 16 effectively closing the opening 12. This will prevent contamination of the water source.

Figure 4:
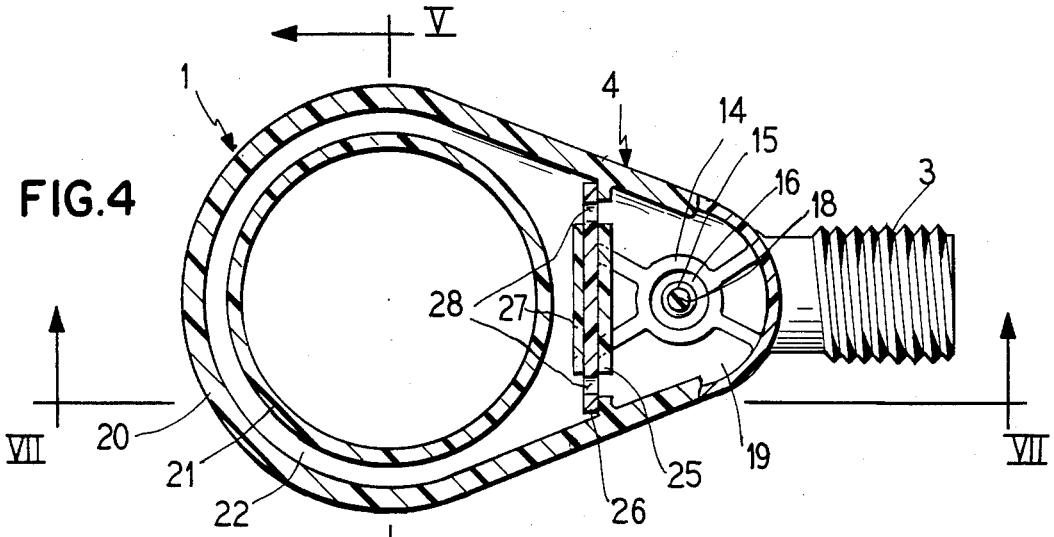
FIG. 4 is a cross-sectional view taken along line IV—IV of FIG. 3.

The chamber 19 is separated from the ring structure 8 by a wall 26 extending from the bottom to the top of the chamber 19 as illustrated in FIGS. 3 and 4. This wall 26 is supported at the bottom by brackets 25 and 27 which terminate short of the top of the chamber 19. These brackets 25 and 27 function in part to prevent the wall 26 from breaking under the water pressure as it exits through the openings 28 and into the ring structure 8.

Figure 5:
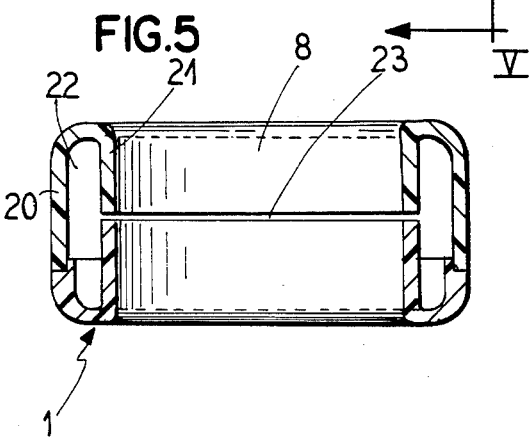
FIG. 5 is a cross-sectional view of the first embodiment taken along line V—V of FIG. 4.
Figure 6:
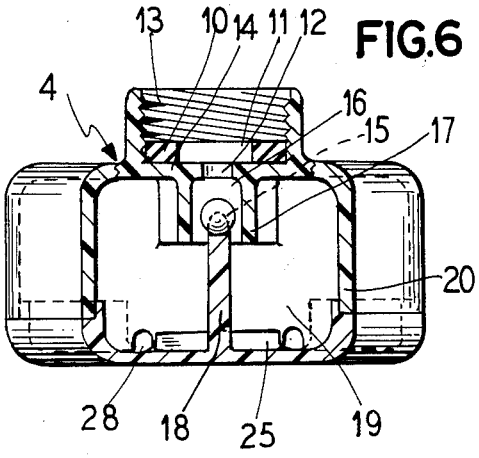
FIG. 6 is a cross-sectional view taken along line VI—VI of FIG. 4.

A first embodiment of the ring structure 8 is illustrated in FIG. 5. This ring structure consists of an outer wall 20 and an inner wall 21 forming a passageway 22 to allow water to completely surround the paint roller and exit through the continuous second water outlet 23 and onto the paint roller fibers.

Figure 7:
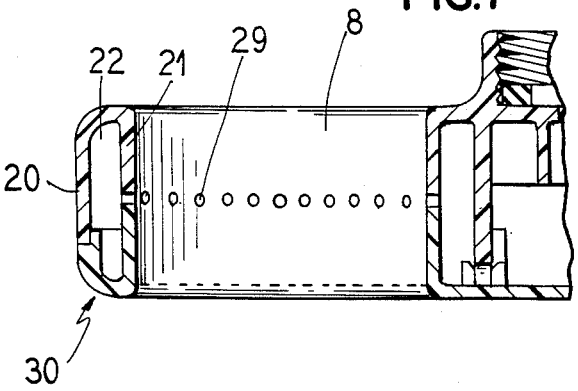
FIG. 7 is a cross-sectional view of the second embodiment taken along line VII—VII of FIG. 4.

A second embodiment of the ring structure 8 is illustrated in FIG. 7. In this embodiment, the only difference is that instead of a continuous second water outlet 23, the second water outlet is composed of a plurality of openings 29. This second ring structure embodiment is generally designated 30.

During a cleaning operation, the roller 7 and handle 6 are connected as shown in FIG. 1. When water is supplied from the faucet 2, the conduit 5 conducts water through the handle 6 to the interior of the roller 7, and the water exits through the roller fibers, cleaning the interior of the roller 7. Water is also simultaneously supplied to the exterior of the roller 7 by the ring structure 8, thereby providing both interior and exterior cleaning of the roller 7.

Although other modifications and changes may be suggested by those skilled in the art, it is the intention of the inventors to embody within the patent warranted hereon all changes and modifications as reasonably and properly come within the scope of their contribution to the art.

We claim as our invention:

1. A device for cleaning interior and exterior surfaces of a roller, wherein the roller is of the type having a conduit connected to the interior thereof, said device for use with a water source and comprising:

a water inlet connected to said water source;

a first water outlet connected to said conduit;

a second water outlet at least partially surrounding an exterior of said roller; and means connecting said water inlet, said first water outlet, and said second water outlet in fluid communication.

2. The device as claimed in claim 1 further comprising:

a one-way valve disposed in the path of fluid communication between said first water outlet and said water inlet for preventing water flow from said conduit to said water source.

3. The device as claimed in claim 2 wherein said one-way valve is a ball check valve.

4. The device of claim 3 wherein said ball check valve comprises:

a continuous wall surrounding said water inlet and forming a chamber on one side thereof;

a post extending at least up to said chamber; and a ball having a diameter greater than said water inlet normally resting on said post in said chamber and being forced by fluid flow against said water inlet thereby blocking said water inlet in the event of fluid flow from said conduit to said water source.

5. The device of claim 4 further comprising a water chamber disposed between said first and second water outlets and said water inlet and wherein water passes through said ball check valve chamber into said water chamber.

6. The device of claim 1 wherein said water source is a faucet and wherein said water inlet has a threaded interior for attachment to said faucet.

7. The device of claim 1 wherein said first water outlet has a threaded exterior for attachment to said conduit.

8. The device of claim 7 wherein said conduit is attached to said roller through a roller handle in fluid communication with the interior of said roller.

9. The device of claim 1 wherein said second water outlet is at least a partial ring structure further comprising:

an outer wall and an inner wall forming a passage to allow fluid flow.

10. The device as claimed in claim 9 wherein said inner wall has a continuous opening for water to exit onto said roller exterior.

11. The device as claimed in claim 9 wherein said inner wall has a plurality of openings for water to exit onto said roller exterior.

12. The device as claimed in claim 9 wherein said ring structure is dimensioned for securing the roller therein while being cleaned.

13. A device for cleaning exterior and interior surfaces of a roller wherein said roller is of the type having a conduit connected to the interior thereof, said device comprising:

a waer inlet adapted for connection to a faucet;

a first water outlet connected to the interior of said roller and adapted for connection to said conduit;

a second water outlet at least partially surrounding the exterior of said roller;

a ball check valve disposed between said water inlet and said first and second water outlets; and a water chamber connecting said water outlet, said first water outlet, and said second water outlet in fluid communication.

14. The device as claimed in claim 13 wherein said second water outlet is at least ring structure further comprising:

an inner wall and an outer wall forming a passage for fluid flow therebetween; and said inner wall having means for water to exit therethrough onto said roller exterior.

15. A device for cleaning interior and exterior surface of a roller of the type having a conduit connected to the interior thereof, said device for use with a water source and comprising:

means for connecting the device to said water source;

means adapted for connection to said conduit for supplying water from said source to the interior of said roller;

means for supplying water from said source to the exterior of said roller; and said means for connection, said means for supplying water to the exterior of said roller and said means for supplying water to the interior of said roller being in fluid communication in a single housing.

16. The device as claimed in claim 15 said means for supplying water to the exterior of said roller is adapted for supporting said roller.

17. The device as claimed in claim 15 wherein said means for supplying water to the exterior of said roller is a ring at least partially surrounding said roller.

18. The device as claimed in claim 17 wherein said ring has an inner wall disposed adjacent to said roller having at least one opening therein for permitting water to pass therethrough to the exterior of the roller.

* * * * *